United States Patent [19]

Franchin et al.

[11] Patent Number: 4,655,021

[45] Date of Patent: Apr. 7, 1987

[54] RETICULAR STRUCTURE

[75] Inventors: Franco Franchin; Paolo Bellomo, both of Treviso, Italy

[73] Assignee: Antonio Eliano Paglianti, Treviso, Italy

[21] Appl. No.: 791,103

[22] Filed: Oct. 24, 1985

[30] Foreign Application Priority Data

Nov. 9, 1984 [IT] Italy ..... 84144 A/84

[51] Int. Cl.[4] ..... E04C 3/02

[52] U.S. Cl. ..... 52/641; 52/643; 52/655; 52/693

[58] Field of Search ..... 52/632, 640, 641, 643, 52/690, 692, 693, 694, 696, 634, 646, 639; 403/379, 388, 393

[56] References Cited

U.S. PATENT DOCUMENTS

| | | | |
|---|---|---|---|
| 1,027,263 | 5/1912 | Lewis | 52/690 |
| 1,645,060 | 10/1927 | Kraft | 52/634 |
| 2,746,580 | 5/1956 | Benz | 52/694 |
| 2,985,264 | 5/1961 | Leonard | 52/640 |
| 3,017,893 | 1/1962 | Greenbic | 52/643 |
| 3,062,340 | 11/1962 | Hunnebeck | 52/640 |
| 4,102,108 | 7/1978 | Cody | 403/388 |

FOREIGN PATENT DOCUMENTS

| | | | |
|---|---|---|---|
| 6000713 | 2/1931 | Australia | 52/654 |
| 181738 | 4/1955 | Austria | 52/640 |
| 183216 | 9/1955 | Austria | 52/641 |
| 614171 | 12/1948 | United Kingdom | 52/655 |

*Primary Examiner*—John E. Murtagh

*Attorney, Agent, or Firm*—Charles W. Fallow; Martin P. Hoffman; Mitchell B. Wasson

[57] ABSTRACT

The reticular structure comprises a plurality of substantially rectilinear axis beams (1) having at least one lower bar (2) and at least one upper bar (2') having different length. Each of these beams (1) is articulated to the adjacent beams at the ends of the bar (2) having larger length and the link between the bars (2') having smaller length is obtained for interposition of an intermediate element (9) having a length to be prearranged according to the outline of the structure to be realized.

7 Claims, 3 Drawing Figures

RETICULAR STRUCTURE

The present invention relates to a reticular structure.

BACKGROUND OF THE INVENTION

Nowadays the covering of loft buildings, stores and like may be made from a plurality of roof trusses, arranged transversely to the building, forming a reticular structure formed by beams firmly bound to one other. Near the junction point of the roof trusses, longitudinal purlins are attached on which the covering is placed.

As the size and the shape of the roof trusses change according to the building to which such a covering has to be applied, such known structures present some drawbacks and particularly:

- the necessity of providing a high number of beams having different length,
- the necessity of constructing curved beams in case of convex coverings,
- the necessity of providing beams having different bending radii according to the covering of the building.

An aim of the invention is to eliminate all these drawbacks and to provide a reticular structure formed by rectilinear modular beams and suitable to be produced with industrial apparatus.

Another aim of the invention is to provide a rectilinear beam reticular structure which may be used for convex coverings.

SUMMARY OF THE INVENTION

These aims are achieved according to the invention by a reticular structure characterized in that it comprises a plurality of substantially rectilinear axis beams having at least one lower bar and at least one upper bar having different length, each of said bars being articulated to the adjacent bars at the ends of the bar having larger length, the bars having smaller length being interconnected by a link having a length to be prearranged according to the outline of the structure to be realized.

Advantageously the structure can have the bars extending along the vertexes of an ideal isosceles upside-down triangle.

Preferably the upper and lower bars can be connected to one other by stiffening elements.

The connector link can consist of two U-shaped sections back soldered to common spacers.

BRIEF DESCRIPTION OF THE DRAWINGS

The present invention is hereinafter further clarified in a preferred embodiment with reference to the enclosed drawings in which.

DESCRIPTION OF THE PREFERRED EMBODIMENT

Figure 1:
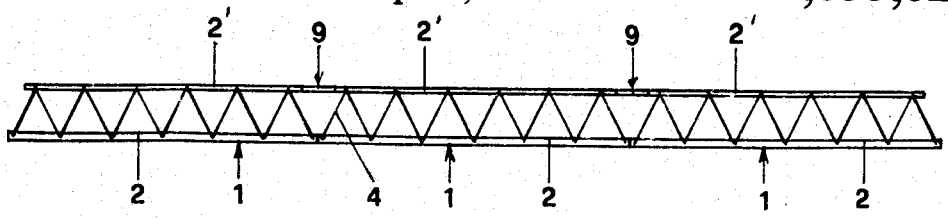
FIG. 1 is a schematic view of a reticular structure according to the invention to be used for plane coverings.

As can be seen in the drawings the reticular structure according to the invention substantially comprises a plurality of trusses 1, each consisting of three circular cross-section longitudinally extending parallel bars 2, 2', extending along the vertexes of an ideal isosceles upside-down triangle. Preferably, the lower bar 2 has length and section larger than that of the two upper bars 2'.

The bars 2, 2' are connected to each other by a plurality of stiffening inclined elements formed as triangular ribbed plates. At one end of the lower bar 2 an eyelet 5 is provided, whereas at the other end a fork element 6 is provided, having its prongs 7 perforated and spaced apart at a distance substantially corresponding to the thickness of the eyelet 5.

Figure 3:
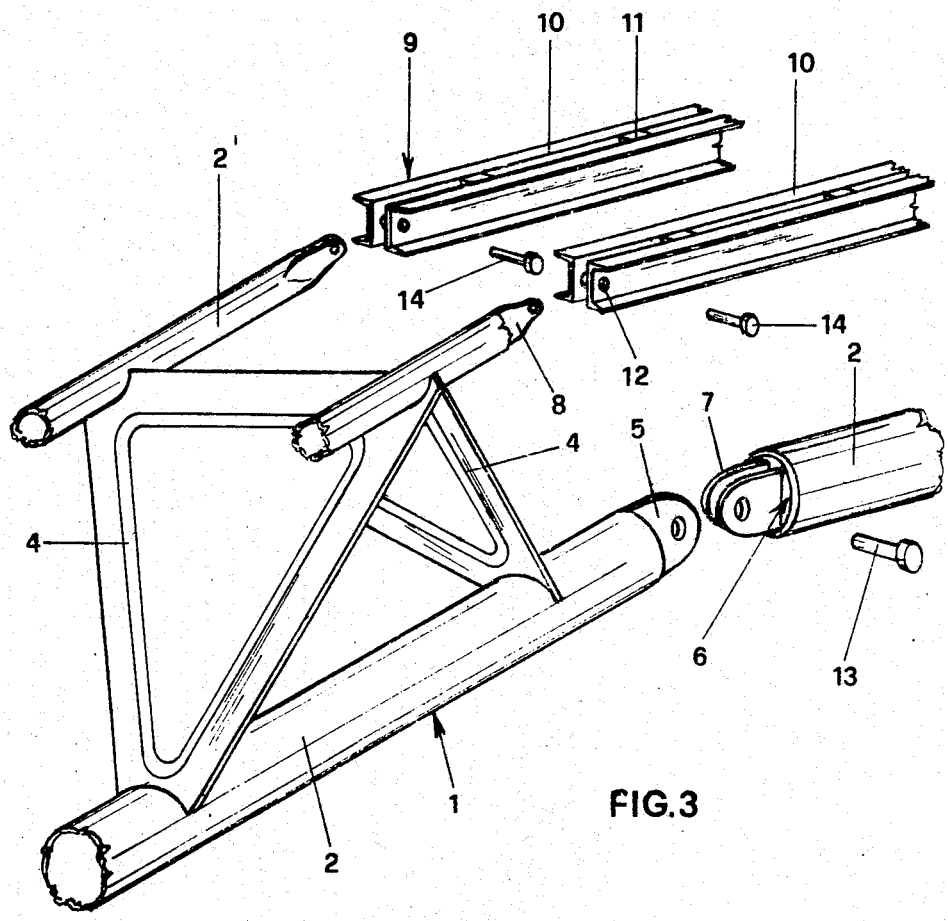
FIG. 3 is a perspective exploded view of the junction between the lower bars, and between each upper bar and the corresponding intermediate link.

Each upper bar 2' has perforated and flattened ends and is provided with an interior stiffening element 8 (see the right upper bar in FIG. 3 which is partially broken away to show the stiffening element within).

The invention also foresees the use of an intermediate connection element 9 formed by two U-shaped sections 10 having the backs soldered to common spacers 11 placed between them; the thickness of the spacers substantially corresponds to that of the flattened ends of the bars 2'. The ends of each U-shaped section 10 are provided with a hole 12.

For constructing a reticular structure according to the invention one operates as follows.

Once the number of the beams 1 needed to form the structure has been established, the lower bars 2 of the adjacent trusses are interconnected by inserting the eyelet 5 inside the progs 7 of the fork element 6 and securing it by a pin 13, thus creating a hinge constraint for each pair of adjacent beams. Then the pins 13 are locked by traditional means preventing their unthreading.

In like manner the upper beams 2' are connected to each other through the intermediate links 9, by inserting the flattened stiffened ends of the upper bars 2' inside the space defined between the U-shaped sections 10 and uniting them by a pin 14.

To realize a rectilinear structure all the intermediate elements 9 have the same length corresponding to the difference of length between the upper bar 2' and the lower bar 2, (see FIG. 1).

Figure 2:
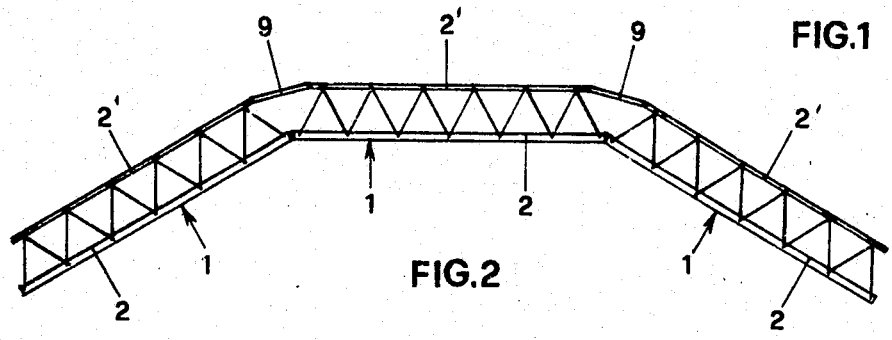
FIG. 2 is a view as FIG. 1 of the structure to be used for convex coverings.

To realize a convex structure the intermediate elements 9 have a length larger than the difference between the length of the lower bars 2 and that of the upper bars 2': in this way the interposition of said intermediate elements allows the realization of a polygonal structure (see FIG. 2).

From the foregoing it is clear that the reticular structure according to the invention allows one to obtain many advantages and in particular:

- simple manufacture with industrial apparatus due to the modularity of the beams,
- high versatility as it can be used for rectilinear, convex and rectilinear-convex coverings.

We claim:

1. A reticular building structure comprising:

a plurality of rectilinear trusses of substantially equal length, each truss comprising at least three parallel bars defining a polygonal cross-section for the truss, said bars being placed at two different levels, those at one level having a length different from those at another level, the longer of said bars being directly connected to like bars of a neighboring truss, and the shorter of said bars being connected to like bars of a neighboring truss by means of a connecting link, whose length thereby determines the shape of said building structure, each truss further comprising a plurality of ribbed polygonal plates, each interconnecting all of said bars of the truss, each plate being oblique to the length of the truss.

2. Structure according to claim 1 characterized in that the bars (2, 2') extend along the vertexes of an ideal isosceles upside-down triangle.

3. Structure according to claim 2 characterized in that the lower bar (2) has length and section larger than the length and section of the upper bars (2').

4. Structure according to claim 1 characterized in that the upper of said bars (2') have the ends flattened, perforated and provided with a stiffening element (8).

5. Structure according to claim 1 characterized in that the link (9) consists of two U-shaped sections (10) separated by common spacers (11).

6. The invention of claim 1 wherein each of said plates is triangular.

7. The invention of claim 6 further comprising an eyelet attached at one end of the lower of said bars and a fork element attached at the other end thereof, the eyelet and fork of adjacent trusses being interconnectable.

* * * * *